US010431075B2

(12) United States Patent
Filatova et al.

(10) Patent No.: US 10,431,075 B2
(45) Date of Patent: Oct. 1, 2019

(54) REMOTE CONTROL WITH ENHANCED MODULARITY

(71) Applicant: Dish Ukraine L.L.C., Kharkov (UA)

(72) Inventors: Ekaterina Filatova, Kharkov (UA); Andrey Kuplevakhsky, Kharkov (UA)

(73) Assignee: DISH Ukraine L.L.C., Kharkov (UA)

( * ) Notice: Subject to any disclaimer, the term of this patent is extended or adjusted under 35 U.S.C. 154(b) by 0 days.

(21) Appl. No.: 16/175,847

(22) Filed: Oct. 31, 2018

(65) Prior Publication Data

US 2019/0080592 A1 Mar. 14, 2019

Related U.S. Application Data

(63) Continuation of application No. 15/529,366, filed as application No. PCT/AU2014/000125 on Nov. 24, 2014, now Pat. No. 10,134,274.

(51) Int. Cl.
*G08C 23/04* (2006.01)

(52) U.S. Cl.
CPC ..... *G08C 23/04* (2013.01); *G08C 2201/20* (2013.01); *G08C 2201/50* (2013.01); *G08C 2201/61* (2013.01)

(58) Field of Classification Search
CPC ..... G08C 23/04; G08C 2201/50; G08C 2201/20; G08C 2201/61
See application file for complete search history.

(56) References Cited

U.S. PATENT DOCUMENTS

| | | | | |
|---|---|---|---|---|
| 6,970,854 | B2 * | 11/2005 | Weigel | G06Q 20/085 235/381 |
| 10,134,274 | B2 | 11/2018 | Filatova et al. | |
| 2003/0172283 | A1 | 9/2003 | O'Hara | |
| 2008/0238709 | A1 * | 10/2008 | Vaziri | H04N 5/4403 340/4.32 |
| 2009/0146779 | A1 | 6/2009 | Kumar et al. | |
| 2011/0121943 | A1 | 5/2011 | Morovitz et al. | |
| 2012/0019361 | A1 * | 1/2012 | Ben Ayed | G06F 21/32 340/5.83 |
| 2014/0282044 | A1 | 9/2014 | Oztaskent | |

OTHER PUBLICATIONS

International Preliminary Report on Patentability dated May 30, 2017 in International Patent Application No. PCT/UA2014/000125 all pages.

International Search Report and Written Opinion dated Jul. 20, 2015 in International Patent Application No. PCT/UA2014/000125 all pages.

* cited by examiner

*Primary Examiner* — Abbas I Abdulselam
(74) *Attorney, Agent, or Firm* — Kilpatrick Townsend & Stockton LLP

(57) ABSTRACT

Various devices, systems, products and methods for customizing a remote control are presented. Sensors are optionally used to aid in the identification of users and user specific remote control configurations and layouts are optionally automatically loaded upon determination that a different user is handling the remote control. The devices, systems, products and methods are useful for minimizing inadvertent changes to system setting and modes due to unanticipated or accidental presses of buttons on a remote control.

20 Claims, 8 Drawing Sheets

REMOTE CONTROL WITH ENHANCED MODULARITY

BACKGROUND

Programmable remote controls are currently available in the consumer market. Most programmable remote controls can be placed into one of two segments: universal remote controls and customizable remote controls. Universal remote controls are generally pre-programmed with remote commands for a variety of devices across a range of device manufacturers. A user can input a device code into a universal remote control in order for the remote to mimic the remote commands of a specific device from a specific manufacturer. Some universal remotes allow for switching between a small variety (e.g., up to 4) of devices that might be used within a home theater system, such as between a TV, stereo, cable box and DVD player, by the press of a single button to select the desired device.

Customizable remote controls, on the other hand, offer significantly increased flexibility to the user, including the ability to reassign remote commands to different buttons and to allow specific buttons to output remote commands for a first device from a first manufacturer, while other buttons output remote commands for a second device from a second manufacturer, without requiring the remote to be placed into a different mode for the second device. Some customizable remotes also allow multiple commands to be sent in sequence with the press of a single button, such as to turn on all components in a home theater system and set device modes appropriately for a particular activity. Programming of such a customizable remote control by a user offers additional challenges beyond simply entering single pin codes to select single devices, however, and software programs and websites are typically used to generate and setup a customizable remote. As compared to universal remotes, customizable remotes also carry a significantly higher price tag—some customizable remote controls may cost up to 20 or 30 times more than a simple universal remote control.

SUMMARY

In various aspects, provided are systems, methods and devices, such as television receivers, display devices and remote controls, for customization of remote control operations. In a related aspect, computer-program products are provided, such as a product tangibly embodied on a non-transitory machine-readable or processor-readable medium with instructions configured to cause a computing device or processor to perform any of the methods described herein. The systems, methods, devices and products described herein optionally utilize one or more techniques for identifying a user of a remote control and changing the functionality of the remote control to establish a preferred functionality for the user. Sensors are optionally used to develop a signature, such as a biometric signature, that identifies a user in real-time in order for independent customization of the available remote commands and layout of the remote control in real-time with little or no user input required.

In embodiments, the systems, methods, device and products described herein allow for activating or deactivating features of a remote control in a way that prevents unanticipated and/or unintended changes to the modes or settings of one or more devices that can be changed with a remote control. For example, the channel up/down buttons on a remote control are optionally disabled once a program is started in order to prevent accidental channel changes. Other configurations are possible for minimizing undesired changes to the modes or settings of one or more devices through random or accidental button presses on a remote control.

In one aspect, provided are methods for customization of a remote control, for example a remote control including one or more buttons, such as physical buttons, switches or soft keys. Various methods of this aspect provide for real-time customization of remote control settings, layouts, operations, remote commands, etc. For example, in some embodiments, customization occurs as remote controls are used or within a short time period of use, such as within 5 seconds, within 3 seconds, within 1 second or within 0.5 seconds. In one embodiment, sensors are used to provide data in real-time that allows identification or authentication of a user so that the user's preferred or otherwise identified layout and configuration can be loaded and implemented on the remote control. Optionally, a step of changing functionality includes changing an illumination function of one or more buttons or changing an illumination color of one or more buttons. Changing an illumination function and/or color is useful, for example, to allow for quick determination of what buttons function and or have had their functionality changed and/or disabled.

A specific method of this aspect comprises receiving signals from one or more sensors associated with the remote control; analyzing the signals in real-time; determining a sensor signature that identifies a user based on the analysis; loading configuration data based on the sensor signature, wherein the configuration data specifies customized functionality of the remote control for the user; and changing functionality of the remote control based on the configuration data. Optionally, the receiving, the analyzing, the determining, the loading and the changing are repeated, thereby allowing different users to be identified, different configuration data to be loaded for each user and different functionality to be implemented on the remote control for each user. Optionally, the receiving, the analyzing, the determining, the loading and the changing are repeated in real-time.

In various embodiments, one or more sensors are associated with the remote control, such as one or more sensors in data communication with the remote control or a processor or other component thereof. The sensors associated with the remote control are optionally implemented as a component of the remote control, such as one or more buttons, switches, biometric sensors or other user- or surface-facing components. Other sensors are optionally implemented as non-user facing sensors, such as accelerometers placed inside of a remote control, such as for identifying and or detecting gestures made with the remote control. In some embodiments, sensors associated with the remote control are positioned on or within other devices, such as a receiver or a display device. Optionally, sensors may be stand-alone devices, such as digital imaging cameras, motion sensors, etc. Useful sensors include, but are not limited to, motion sensors, accelerometers, capacitive sensors, electrical sensors, optical sensors, cameras, biometric sensors, microphones, heart rate sensors, fingerprint readers, facial recognition cameras, eye recognition cameras and the like.

In various embodiments, the sensor signals are used to determine a sensor signature, such as a biometric signature, that uniquely identifies the user. In other embodiments, the sensor signals are used to identify a category of user, which may not uniquely identify the user. For example, the sensor signature may identify an approximate age of the user or whether the user is a child or an adult. Other distinctions are possible, including an age or approximate age range or other identifying characteristic of a user. For example, a signature may identify whether a child is a toddler, primary school age child, teenager, etc.

In various embodiments, sensor signals are used to authenticate a user. For example, in embodiments, biometric sensors are used to generate a biometric signature for a user, which is optionally compared with one or more known biometric signatures to authenticate the user. In another embodiment, the one or more sensors includes one or more input devices, and signals received from the sensors include a user authentication code from the one or more input devices, such as a sequence of one or more button presses or one or more gestures. Optionally, a step of analyzing the signals includes authenticating the user.

In a specific embodiment, the one or more sensors includes one or more buttons or switches, and a step of analyzing the signals in real-time to determine a sensor signature includes detecting a button press or a change in switch position that selects or identifies the user. For example, upon selection or identification of the user in this way, changing functionality of the remote control based on the configuration data optionally includes deactivating reactivating, ignoring or acknowledging one or more commands or buttons of the remote control. Optionally, one or more buttons or switches on or associated with the remote control can be used to deactivate or ignore commands from or buttons of the remote control. For example, in one embodiment, a switch on a remote control functions as an on/off switch for the remote control, essentially disabling or re-enabling all buttons on the remote control by a single switching action. In other embodiments, a switch on or associated with a remote control functions as a user selection or user mode switch, allowing for quickly changing the configuration and/or layout of the remote control.

Optionally, a sensor associated with a remote control comprises a data transceiver. Inclusion of a data transceiver is advantageous, for example, to allow configuration data to be transmitted to and/or received by a remote control or an associated device, such as a display device, receiver or set top box (STB). For example, a method of this aspect optionally further comprises receiving configuration data from a communications device using the data transceiver. A variety of data transceivers are useful with various aspects. For example, a data transceiver is optionally wired or wireless. Useful wireless data transceivers include infrared transceivers, optical transceivers and radio frequency transceivers, such as Bluetooth or Wi-Fi transceivers. In this way, configuration data can be received using the data transceiver, such as from a laptop, computer, internet server, STB, etc. For example, useful configuration data optionally establishes which remote commands are to be output from the remote control in response to presses to one or more buttons of the remote control. In various embodiments, a step of changing functionality of the remote control based on the configuration data includes customizing a layout of an interface of the remote control, such as a touchscreen interface.

In various embodiments, aspects of the methods, systems, devices and products described herein allow for tracking button usage on a remote control. For example, a specific method embodiment further comprises a step of tracking button usage on the remote control. Optionally, a method embodiment further comprises reporting the button usage to a supervisor user. Tracking and reporting button usage is useful, for example, for various situations where a supervisory user wishes to determine when and which buttons were pressed on a remote, such as by another user. This situation may be convenient for parents to determine how long a child was watching television and which programs or channels the child watched or attempted to watch.

In another aspect, provided are devices and systems, such as remote controls, receivers, such as television receivers, and/or display devices, such as a television. In one embodiment, a remote control of this aspect comprises one or more buttons for receiving input from a user; a wireless transmitter for transmitting output commands in response to button presses; one or more processors; and a memory communicatively coupled with and readable by the one or more processors and having stored therein processor-readable instructions. Optionally, the processor-readable instructions, when executed by the one or more processors cause the one or more processors to perform any of the methods described herein. For example, in one embodiment, the processor readable instructions, when executed by the one or more processors, cause the one or more processors to: receive signals from one or more sensors associated with the remote control; analyze the signals in real-time; determine a sensor signature that identifies a user; load configuration data based on the sensor signature, the configuration data specifying customized functionality of the remote control for the user; and change functionality of the remote control based on the configuration data.

In another embodiment, a television receiver of this aspect comprises one or more sensors associated with a remote control; a wireless receiver for receiving remote commands from the remote control; one or more processors; and a memory communicatively coupled with and readable by the one or more processors and having stored therein processor-readable instructions. Optionally, the processor-readable instructions, when executed by the one or more processors cause the one or more processors to perform any of the methods described herein. For example, in one embodiment, the processor readable instructions, when executed by the one or more processors, cause the one or more processors to: receive signals from the one or more sensors associated with the remote control; analyze the signals in real-time to determine a sensor signature that identifies a user; load configuration data based on the sensor signature, the configuration data specifying customized functionality of the remote control for the user; and change functionality of the remote control based on the configuration data.

In another aspect, provided are computer program products, such as non-transitory processor-readable media for real-time customization of remote control devices, receivers, such as television receivers, and/or display devices, such as televisions. In one embodiment, a processor readable medium of this aspect comprises processor-readable instructions. Optionally, the processor-readable instructions, when executed by one or more processors cause the one or more processors to perform any of the methods described herein. For example, in one embodiment, the processor readable instructions, when executed by one or more processors, cause the one or more processors to: receive signals from one or more sensors associated with the remote control; analyze the signals in real-time to determine a sensor signature that identifies a user; load configuration data based on the sensor signature, the configuration data specifying customized functionality of the remote control for the user; and change functionality of the remote control based on the configuration data.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
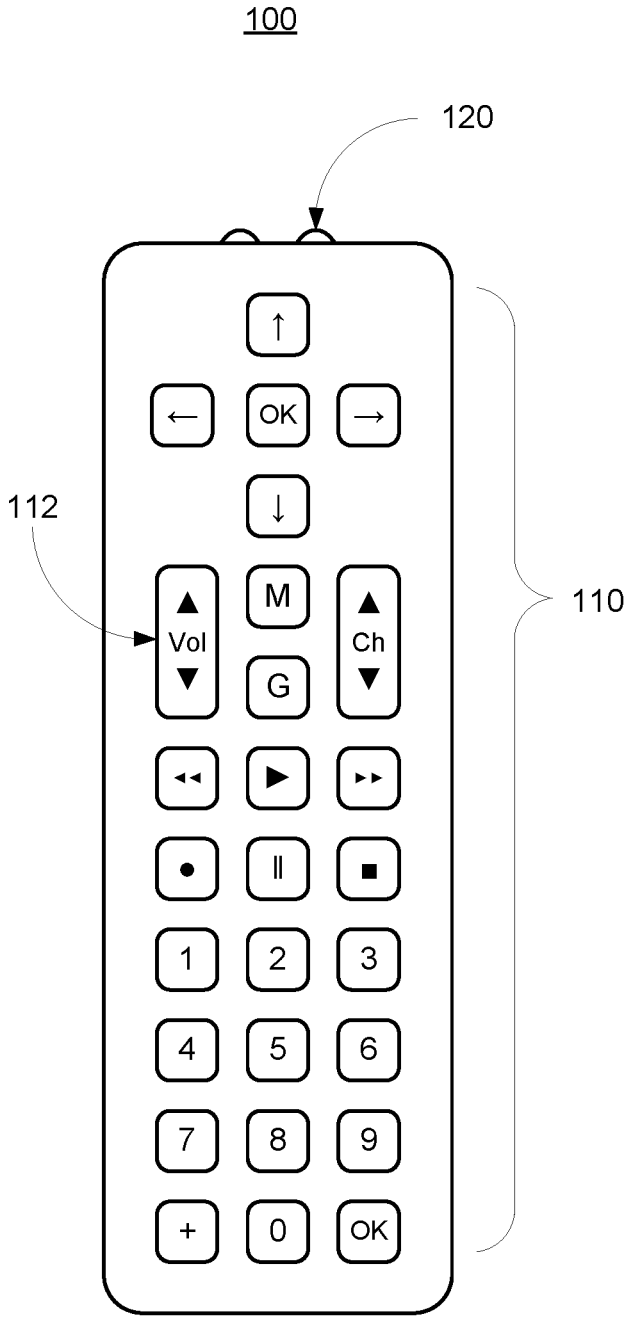
FIG. 1 illustrates a remote control embodiment.

It is often desirable to have the ability to change settings on a remote control, such as button configurations and layouts, as users may have particular preferences as to what various buttons on the remote do when they are pressed. For example, some users may prefer that the play and pause buttons on a remote each function identically as a toggle between playing and pausing video or audio playback, while other users may prefer that a play button and a pause button have independent functions—the play button only begins or resumes playback, while the pause button only halts playback but does not resume playback.

Programmable remotes, such as customizable remotes, may allow for the customization of button layouts, but the process of changing between button layouts typically requires a user to use a program on a computer or log into an Internet website in order to generate the remote control layout and then program the remote.

Other programmable remotes, such as universal remotes, do not offer such customizable functionality, but provide simply for the ability to set the remote for a static set of output commands for a single device by entering a code associated with a particular hardware and/or device manufacturer. Such functionality may be of limited practical use, however, as remote commands are rarely, if ever, uniform across device manufacturers or even across different devices of a single manufacturer.

Other situations may dictate a need to disable buttons, at least temporarily. For example, situations may arise where a user is watching television and wishes to have their experience uninterrupted, so it is desirable to disable button presses or commands from the remote control from being recognized in order prevent a channel change, a pause, a stop, a fast forward or rewind from occurring. This situation may also occur where an inexperienced user, such as a child, obtains the remote and presses buttons without knowing or intending the consequence and disabling the buttons could prevent inadvertent changes.

Similarly, it may be desirable to limit the functionality of certain remote buttons or commands in some situations. For example, it is useful to limit the maximum audio output of a television or audio system in order to protect against hearing loss. Disabling the volume up button on a remote control in real-time upon detection of a specific audio or decibel level provides a simplified way to offer such protection. Aspects of the invention provide for the ability to change remote control configurations in real-time upon analyzing sensor signals.

To achieve flexibility, embodiments of the invention are capable of uniquely identifying a user of a remote control and automatically loading, in real time, a specific remote control configuration for the user, such that upon handling the remote control, the user's preferred remote control layout is available. Other embodiments allow for identification of a category of user and automatic loading of a remote control layout consistent with the user's category. For example, aspects of the invention can distinguish between adults and children handling a remote control and can load an associated preferred configuration that may disable or enable one or more buttons or remote commands.

Certain embodiments also allow tracking of button presses and recording or reporting of the sequence and timing of button presses. Such a configuration optionally allows a supervisor user, such as a parent supervising a child, to determine when and whether another user was using the remote control and to determine what buttons and activities they were performing or attempting to perform. For example, a parent could determine what channels or programs a child was watching or attempting to watch or could determine whether and how long the child was flipping between channels or programs instead of doing something more productive.

Aspects of the invention utilize one or more sensors to aid with the determination of a user's identity, such as to allow a configuration associated with the user to be automatically loaded in real-time so that the user's preferred remote control layout is available with little or no specific input from the user. In various embodiments the sensors are associated with the remote control, such as directly incorporated into a remote control, incorporated into a receiver, such as a television receiver, or into a display device, such as a television or the sensors may be standalone devices that provide signals or data to a remote control, receiver or display device.

A variety of sensors are useful with various aspects described herein, including, but not limited to, sensors such as capacitive sensors, electrostatic sensors, pressure sensors, motion sensors, accelerometers, cameras, microphones and biometric sensors. Useful biometric sensors include, but are not limited to, fingerprint readers, palm print readers, voice recognition sensors, heart rate sensors, face recognition sensors, iris scanner, temperature sensors, skin conductivity sensors and gesture sensors. In some embodiments, input devices, such as buttons, soft keys and switches are sensors useful with aspects of the devices, systems and methods described herein.

Turning now to FIG. 1, depicted is a remote control 100 including a plurality of buttons 110 and an infrared transmitter 120. Other button 110 configurations and layouts are contemplated, including configurations that entirely use touchscreen displays for completely customizable soft key layouts and labels, configurations that use one or more physical soft keys that are individually labeled with a light emitting diode (LED), liquid crystal display (LCD) or other display, and combinations of touchscreen, soft keys, toggle switches and hard keys. For remote control 100, however, a user can input a sequence of button presses on buttons 110 to authenticate the user, such as by way of a pin code or credential, and allow the remote control 100 to load a user profile to provide the specific functionality of the remote control that the user prefers.

From the perspective of the remote control, the buttons 110 function as sensors, with the sequence of presses of buttons 110 generating signals that can be analyzed in real time to determine a sensor signature. For example, the sensor signature can be a pin code or other authentication code that identifies a user. Configuration data can then be loaded based on the signature, such as to specify customized functionality of the remote control 100, allowing the functionality of the remote control 100 to be changed to match the preferences of the user.

Optionally, the configuration can specify that one or more of buttons 110 are to be disabled. For example, it may be desirable to disable volume buttons 112 so that, once set, the volume levels of a television or audio system cannot be changed. Optionally, visual indicators can provide feedback to the user to indicate which buttons are disabled. For example, when volume buttons 112 are disabled, they may illuminate with a red color to indicate they are non-functioning. In another embodiment, volume buttons 112 may not illuminate when pressed, indicating they are disabled, while others of buttons 110 may illuminate when pressed, indicating they are enabled. Other illumination configurations are possible.

Figure 2:
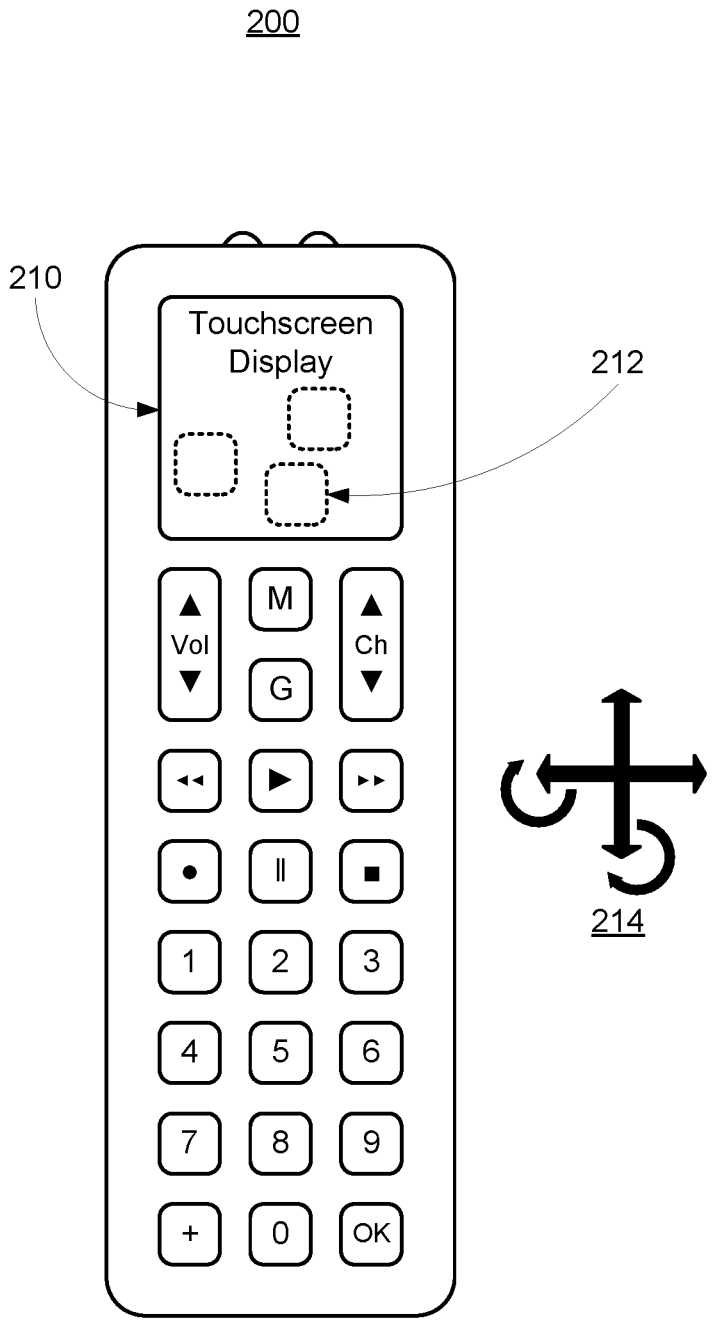
FIG. 2 illustrates a remote control embodiment including a touchscreen display and accelerometers.

FIG. 2 depicts an embodiment of a remote control 200 including physical buttons and a touchscreen interface 210. One or more soft keys 212 are available on the touchscreen interface, providing the ability to have different custom interfaces. For example, upon identifying a different user, a different configuration can be loaded and the functionality, layout and display of touchscreen interface 210 can be automatically changed to match those preselected by the user.

Also included are one or more accelerometers or motion sensors, with directions 214 schematically illustrating the ability of the accelerometers or motion sensors to detect motion, tilting, rotation, etc. In embodiments, the accelerometers or motion sensors can detect gestures, and can distinguish between users by determining how a user holds and moves the remote. For example, a specific gesture could be used as an authentication signal to trigger the remote to switch to a different user configuration. For example, a user may move the remote in a pattern similar to writing their name or some other unique gesture. In this way, various configurations can be loaded in real-time when various users pick up the remote and motion an authenticating gesture, such that the user is presented with remote control functionality matched to the user.

In another example, the remote optionally can use signals from the accelerometers or motion sensors to determine whether a known or unknown user is holding the remotes and automatically load a configuration that disables one or more buttons. Such a technique is beneficial, for example, for limiting the ability of a child, such as a toddler, that picks up a remote from changing channels, changing volume, changing inputs, etc., through random button presses.

Figure 3:
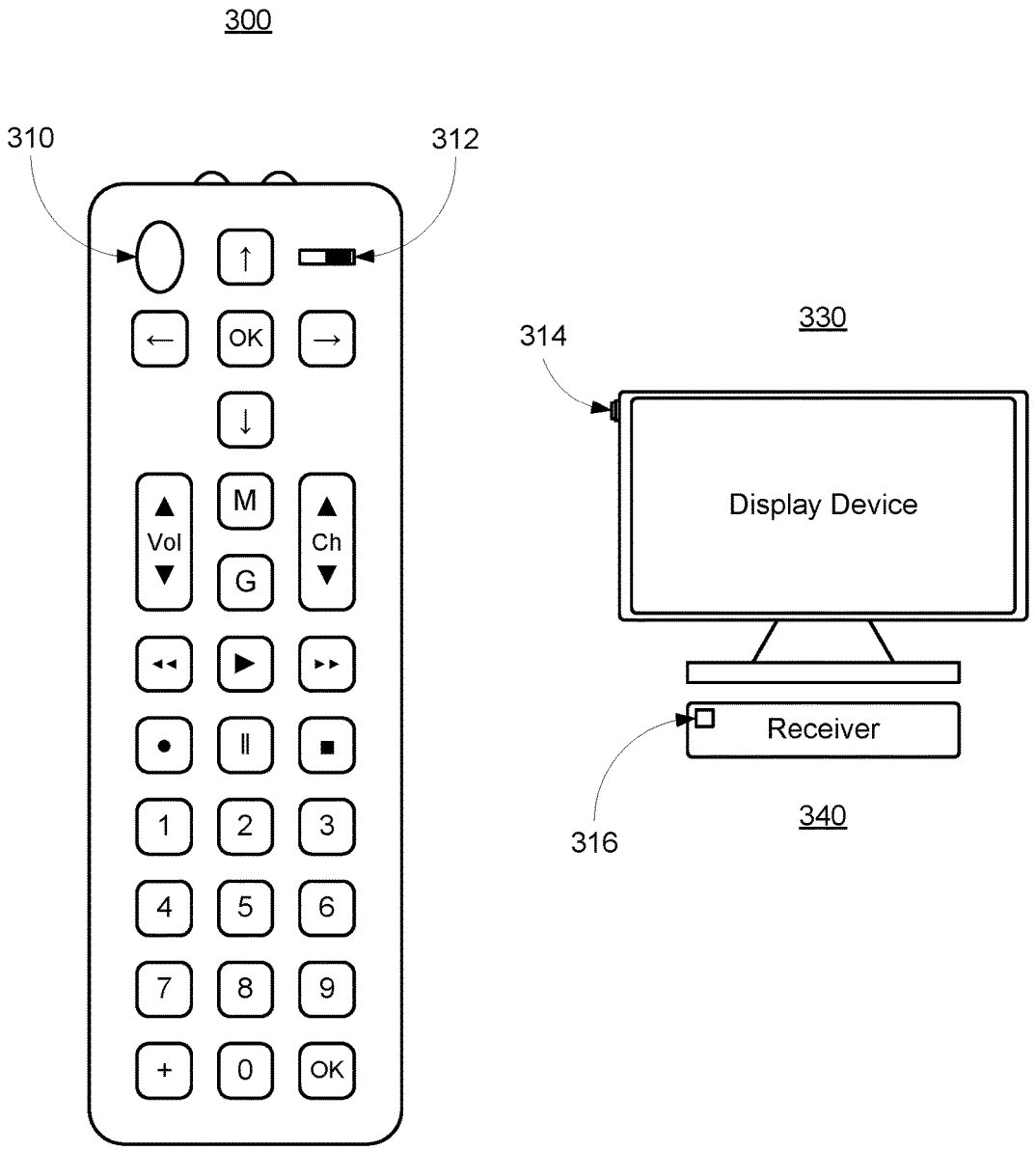
FIG. 3 illustrates a system embodiment including a remote control, a display device and a receiver.

FIG. 3 depicts a system including remote control 300, display device 330 and receiver 340. As illustrated, remote control 300 includes a biometric sensor 310, depicted here as a fingerprint reader. Such a configuration advantageously allows a user to authenticate with the remote control 300 by scanning their finger to generate a biometric signature and the system loading a remote control configuration for the user after determining that the biometric signature identifies the user. Such a configuration is useful, for example, for uniquely identifying a user, and allows multiple users to independently authenticate with the remote control 300 so that their configuration can be loaded to enable a desired functionality to be implemented on the remote control 300.

The remote control 300 shown in FIG. 3 also includes a sensor exemplified as a switch 312. Switch 312 can serve a variety of functions, depending on the configuration. For example, in one configuration, switch 312 functions as a user selection switch, such that with the switch 312 in a first position, a first user configuration is loaded, with associated functionality implemented on the remote 300. When the switch 312 is moved to a second position, a second user configuration is loaded, with a second functionality implemented on the remote 300.

In another configuration, switch 312 can function similar or identical to an on/off switch. For example, when switch 312 is in a first position, a user configuration is loaded, with associated functionality implemented on the remote 300. When switch 312 is moved to a second position, a second configuration is loaded, such that all buttons on remote 300 are disabled or a subset of the buttons on remote 300 are disabled.

Similar functionality can be implemented by way of sensor 314 and sensor 316, positioned on display device 330 and receiver 340, respectively. For example, sensor 314 and sensor 316 can be implemented as any of the sensors described herein, such as to allow unique authentication of a user and an associated configuration to be loaded to allow specific functionality of the remote control 300. In one embodiment, sensor 314 or sensor 316 is implemented as a button that, when pressed, cycles through a selection of configurations, such that upon each button press a different configuration is loaded, with associated functionality for the remote control 300 implemented on each button press.

In various embodiments, the changing of configurations can occur at any one or more of the remote control 300, the display device 330 or the receiver 340. For example, changing the configuration at the remote control 300 can function to change the set of remote commands associated with the buttons of the remote control 300 for each configuration loaded. Similar functionality can be implemented by changing what the remote commands do when detected by the display device 330 or the receiver 340. For example, upon loading a different configuration, the set of remote commands associated with the buttons of the remote control 300 can remain unchanged, while what each command causes to happen when detected by the display device 330 or the receiver 340 will change. Various intercombinations are also possible.

For example, in one embodiment, sensor 314 or sensor 316 is implemented as a button and, upon pressing the button a first time, commands sent from the remote control 300 are ignored by display device 330 or receiver 340. Upon pressing the button a second time, commands sent from the remote control 300 are acknowledged. Alternatively, upon pressing the button a first time, a subset of commands sent from the remote control 300 are ignored by display device 330 or receiver 340, while others are acknowledged. Upon pressing the button a second time, all commands sent from the remote control 300 are acknowledged.

Figure 4:
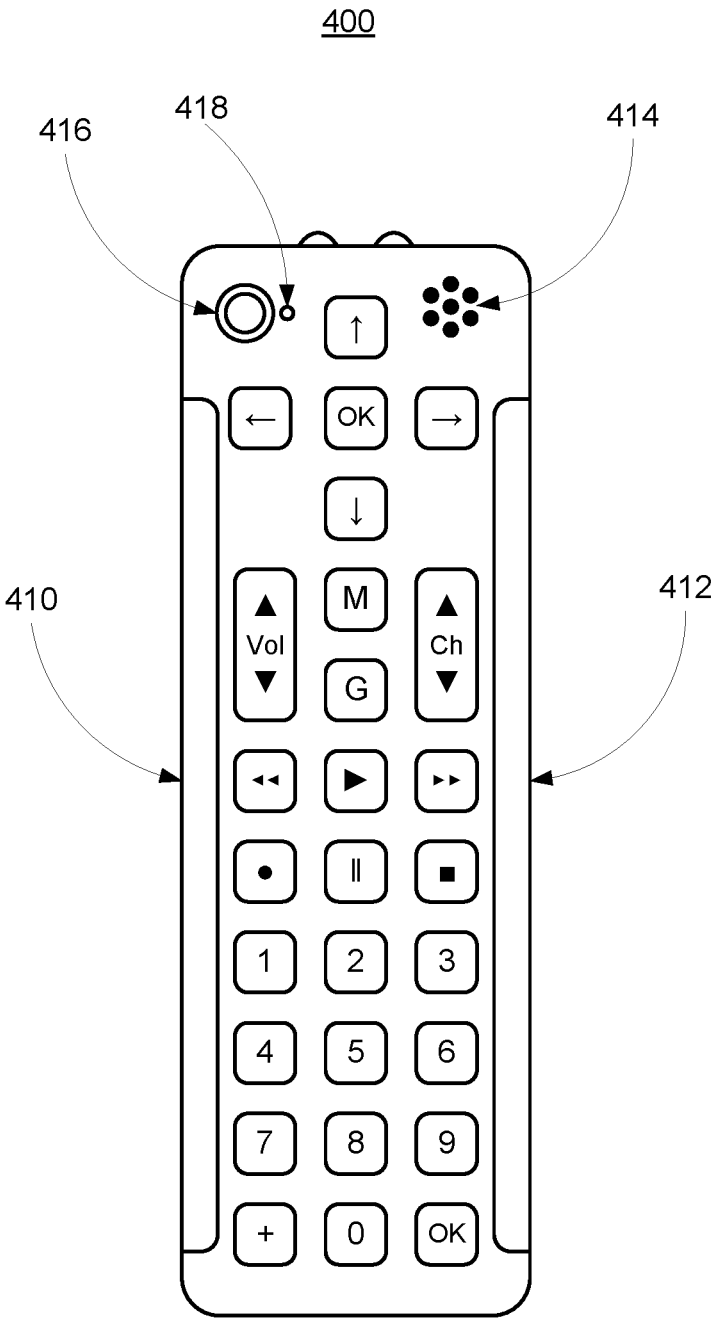
FIG. 4 illustrates a remote control embodiment including biometric sensors.

FIG. 4 illustrates another remote control 400 embodiment that includes a number of sensors which optionally function as biometric sensors. For example, sensors 410 and 412 are optionally capacitive sensors, which provide the ability to determine when the remote control 400 is being held. These sensors can provide a biometric signature, which can indicate the contact area upon which the remote is being held. Such area can optionally identify users with different size hands. In another example, sensors 410 and 412 optionally include finger or palm print readers and can identify users by their finger or palm prints.

In another example, sensors 410 and 412 optionally include voltage sensors and can measure electrical activity of a heart, such as to determine a heart rate and/or to identify a user based on electrocardiography measurements. Although, in some embodiments, a user may not be uniquely identified by their heart rate, such a configuration is useful for determining an approximate age of the user and can, for example, distinguish between adults and children based on their heart rates. For example, a child's heart rate may fall within the range of 80-160 beats per minute, while an adult's heart rate may fall within the range of 60-100 beats per minute. Aspect of the invention can use historical heart rate information and user input confirmation to aid in the identification of a user's age range based on heart rate.

Remote control 400 also includes a microphone 414. In embodiments, microphone 414 is useful, for example, as a biometric sensor for voice recognition. As will be understood by the skilled artisan, voice recognition provides a way to uniquely identify a user based on their vocal signature. Other embodiments are contemplated, for example, where microphone 414 is used to receive voice commands, such as to change the functionality of the remote control 400 in real-time upon detection of specific voice commands. Alternatively, microphone 414 can be used to authenticate the user though use of a voice input password or pass phrase. Other configurations are possible, including using microphone 414 to input non-vocal audio inputs, such as rhythms, tones, etc., to authenticate a user.

Remote control 400 also includes a camera 416 and light source 418. In embodiments, camera 416 is an infrared camera and light source 418 is an infrared light source. Use of an infrared camera and/or light source is beneficial, in embodiments, for providing the ability to view a user or environment without disturbing the user, as the infrared light source will not be visible by the user. In other embodiments, camera 416 is a visible light camera and light source 418 is a visible light source. In various embodiments, camera 416 is capable of detecting light across multiple regions of the electromagnetic spectrum, including infrared, visible and/or ultraviolet light.

Use of camera 416 and light source 418 optionally provides for the ability to use face recognition and/or iris recognition for authenticating a user or for generating commands, such as gesture based commands. Optionally, camera 416 and light source 418 can be used to determine a heart rate of a user, such as by placing a finger over the camera and detecting changes in the skin color and transparency caused by the surges in blood flow as the heart beats. Other imaging techniques are useful for determining blood flow and heart rate, such as by monitoring minute changes to facial color and reflectivity as blood flows through facial blood vessels. As with electrocardiography measurements, in embodiments, heart rate determined in this way may be used to identify a user or an approximate age of a user to allow a specific configuration of remote control 400 to be loaded. In another embodiment, camera 416 is useful for sensing a temperature, such as a facial or other body temperature of a user. Such sensing is useful for detecting a user's temperature signature. Detection of a temperature signature may similarly be used, for embodiments, to identify an approximate age of a user. For example, a toddler may have a higher temperature signature than an adult.

Figure 5:
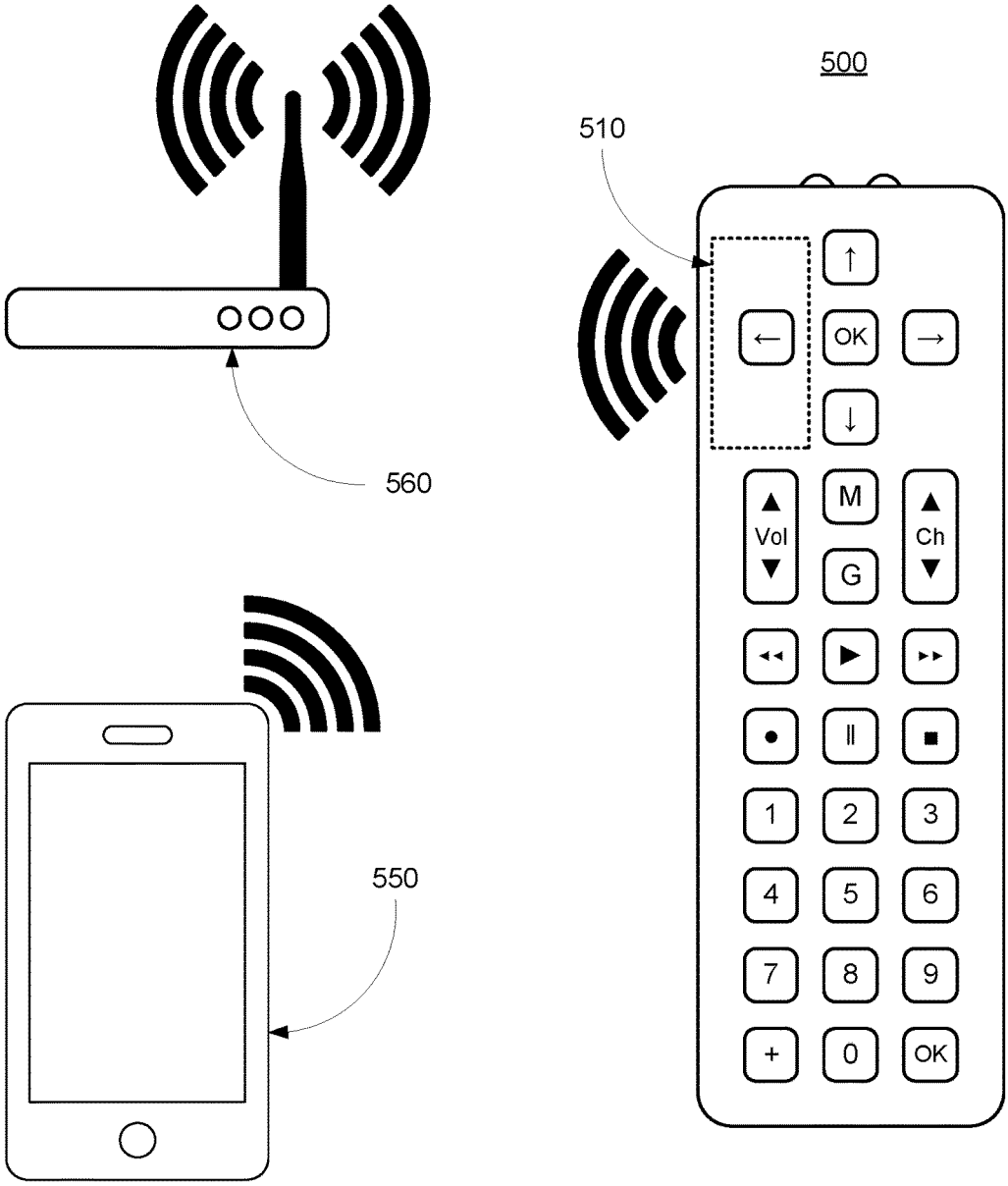
FIG. 5 illustrates a remote control embodiment including a wireless transceiver for communicating with network devices.

FIG. 5 illustrates a remote control 500 that includes a sensor that is a wireless transceiver 510. In various embodiments, wireless transceiver 510 allows remote control 500 to communicate with other devices, such as a smartphone 550 or a wireless network 560. Any of a variety of wireless configurations and protocols are useful with this aspect, including, but not limited to, Bluetooth, Wi-Fi, near field communication (NFC), cellular radio technology, wireless Universal Serial Bus (USB), Z-Wave, ZigBee, IrDA and the like. Including wireless transceiver 510 in remote control 500 optionally provides for user and device configurations to be loaded wirelessly into remote control.

In another embodiment, remote control 500 can implement recording/tracking of button presses and inputs. Including wireless transceiver 510 allows tracked button presses to be reported wirelessly to a remote device, such as a handheld portable electronic, smartphone, laptop, etc. In this way, a supervisory user can be informed of the timing, frequency and order of button presses that another user makes without having to be present and watching the user. Such a configuration is particularly useful, in embodiments, for parents who wish to monitor the television or video watching habits of a child. In addition, commands can be sent to remote control 500 from another device, such as smartphone 550, to change the functionality of the remote control 500 in real-time. Such a configuration is useful for a supervisory user to change the functionality of the remote control 500 on demand from a remote location, such as if it is determined that a wrong user configuration is loaded on remote control 500 or when the supervisory user determines that it is appropriate to enable, disable or change remote control functionality. For example, a parent can change functionality of remote control 500 from a smartphone before and/or after a child completes homework or chores, etc.

As will be understood by the skilled artisan, any one or more of the sensors described herein can be implemented in a remote control individually or in any combination with one or more other sensors. In addition, the skilled artisan will understand that the sensors described herein can be implemented as a component of a remote control or some other device associated with the remote control, such as a display device or receiver. In some embodiments, the sensors are standalone sensors or incorporated into other devices, such as tablets, laptops, smartphones, etc., that are in data communication with a remote control, display device or receiver. Although a number of specific embodiments are described above and illustrated in the accompanying drawing figures, such description and figures are for illustrative purposes only and do not limit the possible configurations and combinations of sensors.

Figure 6:
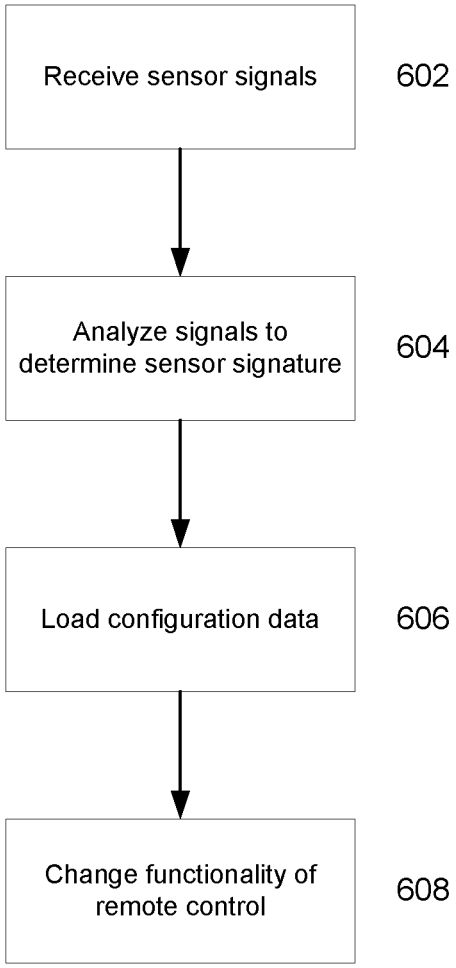
FIG. 6 provides an overview of a method embodiment for customization of a remote control.

FIG. 6 illustrates an embodiment of a method 600 for customization of a remote control. Method 600 is optionally performed using any of the systems and devices described herein. For example, any of remote controls 100, 200, 300, 400 or 500 of FIGS. 1-5 may be optionally used. Alternatively, the system, the display device 330 or the receiver 340 of FIG. 3 may be optionally used. Components of such systems and devices may be implemented using hardware, software and/or firmware. Further, the performance of method 600 optionally includes one or more instances of the component of computer system 800 of FIG. 8.

At step 602, sensor signals are received. For example, sensor signals can be received from sensors implemented directly as a part of a remote control, from stand-alone sensor devices or from sensor devices that are components of a device associated with the remote control, such as a display or receiver. At step 604, the sensor signals are analyzed to determine a sensor signature, such as to allow for a user to be identified. At step 606, configuration data is loaded, such as configuration data that specifies a layout or configuration. Upon or after loading the configuration data, the functionality of the remote control is changed, at step 608.

Figure 7:
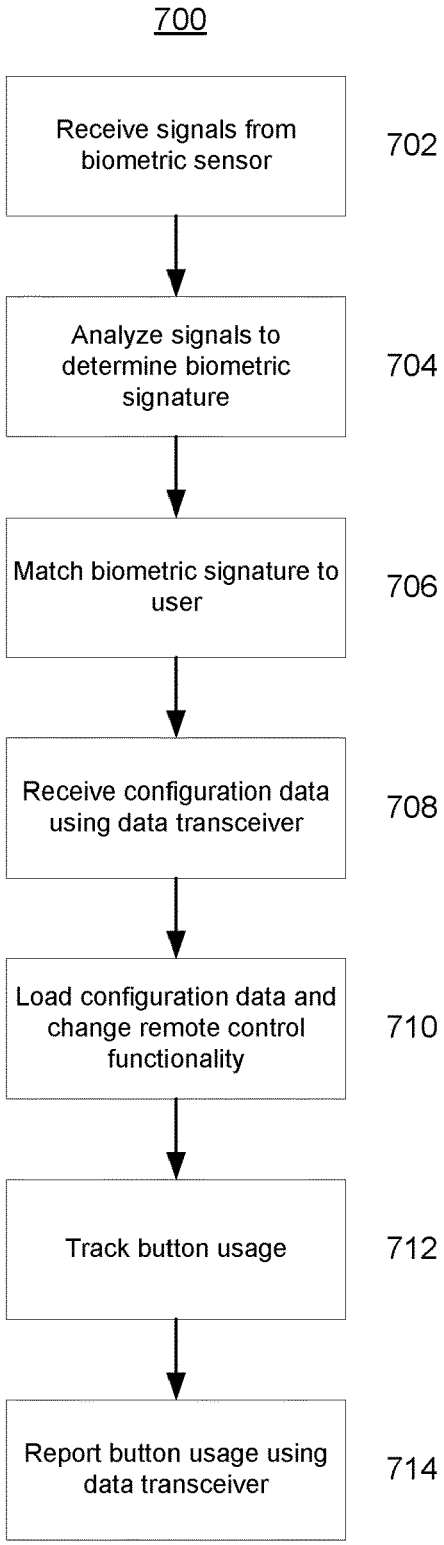
FIG. 7 provides an overview of a method embodiment for customization of a remote control.

FIG. 7 illustrates an embodiment of a method 700 for customization of a remote control. Method 700 is optionally performed using any of the systems and devices described herein. Components of such systems and devices may be implemented using hardware, software and/or firmware. Further, the performance of method 700 optionally includes one or more instances of the component of computer system 800 of FIG. 8.

At step 702, sensor signals are received from a biometric sensor. For example, signals can be received from biometric sensors such as a fingerprint reader, a palm print reader or an eye or facial recognition camera. At step 704, the sensor signals are analyzed to determine a biometric signature of the user. For example, a fingerprint or other biometric information can be provided as a digital file. At step 706, the biometric signature is matched to a user. For example, the biometric signature is optionally compared with one or more known biometric identities stored for one or more users in order to determine that the biometric signature obtained as part of the analysis identifies a user. At step 708, configuration data is received using a data transceiver, for example in response to identification of the user at step 706. At step 710, the configuration data is loaded and the functionality of the remote control is changed.

At step 712, the button usage of the remote control is tracked and/or recorded. For example, the number, frequency, duration and timing of button presses may be tracked and or recorded. This information is optionally stored directly within the remote control. At step 714, the button usage data is reported using the data transceiver.

Figure 8:
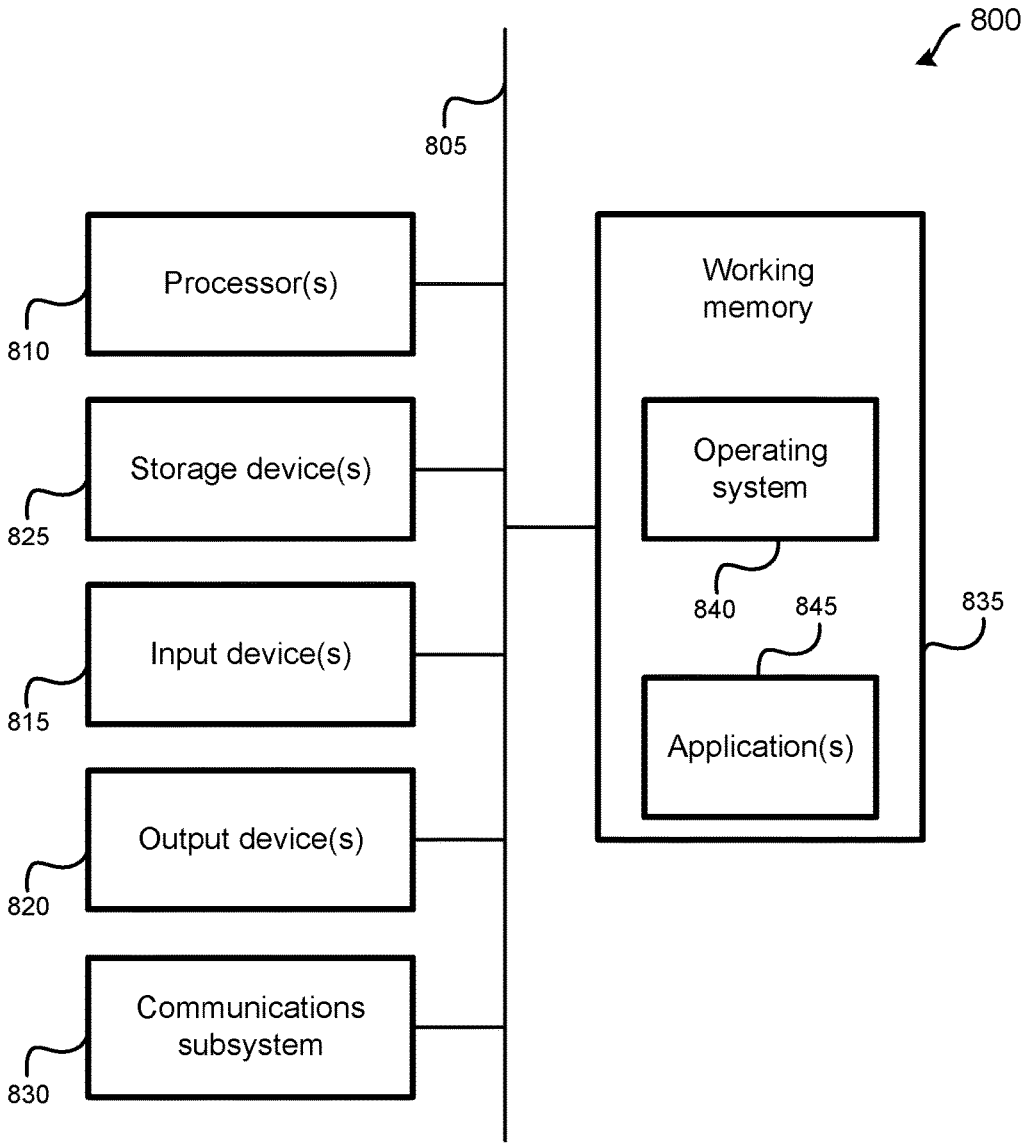
FIG. 8 illustrates an embodiment of a computer system.

A computer system as illustrated in FIG. 8 may be incorporated as part of the previously described computerized devices, such as the described television receivers or remote controls. FIG. 8 provides a schematic illustration of one embodiment of a computer system 800 that can perform various steps of the methods provided by various embodiments. It should be noted that FIG. 8 is meant only to provide a generalized illustration of various components, any or all of which may be utilized as appropriate. FIG. 8, therefore, broadly illustrates how individual system elements may be implemented in a relatively separated or relatively more integrated manner.

The computer system 800 is shown comprising hardware elements that can be electrically coupled via a bus 805 (or may otherwise be in communication, as appropriate). The hardware elements may include one or more processors 810, including without limitation one or more general-purpose processors and/or one or more special-purpose processors (such as digital signal processing chips, graphics acceleration processors, video decoders, and/or the like); one or more input devices 815, which can include without limitation a mouse, a keyboard, remote control, and/or the like; and one or more output devices 820, which can include without limitation a display device, a printer, and/or the like.

The computer system 800 may further include (and/or be in communication with) one or more non-transitory storage devices 825, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable and/or the like. Such storage devices may be configured to implement any appropriate data stores, including without limitation, various file systems, database structures, and/or the like.

The computer system 800 might also include a communications subsystem 830, which can include without limitation a modem, a network card (wireless or wired), an infrared communication device, a wireless communication device, and/or a chipset (such as a Bluetooth™ device, an 802.11 device, a WiFi device, a WiMax device, cellular communication device, etc.), and/or the like. The communications subsystem 830 may permit data to be exchanged with a network (such as the network described below, to name one example), other computer systems, and/or any other devices described herein. In many embodiments, the computer system 800 will further comprise a working memory 835, which can include a RAM or ROM device, as described above.

The computer system 800 also can comprise software elements, shown as being currently located within the working memory 835, including an operating system 840, device drivers, executable libraries, and/or other code, such as one or more application programs 845, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be stored on a non-transitory computer-readable storage medium, such as the non-transitory storage device(s) 825 described above. In some cases, the storage medium might be incorporated within a computer system, such as computer system 800. In other embodiments, the storage medium might be separate from a computer system (e.g., a removable medium, such as a compact disc), and/or provided in an installation package, such that the storage medium can be used to program, configure, and/or adapt a general purpose computer with the instructions/code stored thereon. These instructions might take the form of executable code, which is executable by the computer system 800 and/or might take the form of source and/or installable code, which, upon compilation and/or installation on the computer system 800 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 800) to perform methods in accordance with various embodiments of the invention. According to a set of embodiments, some or all of the procedures of such methods are performed by the computer system 800 in response to processor 810 executing one or more sequences of one or more instructions (which might be incorporated into the operating system 840 and/or other code, such as an application program 845) contained in the working memory 835. Such instructions may be read into the working memory 835 from another computer-readable medium, such as one or more of the non-transitory storage device(s) 825. Merely by way of example, execution of the sequences of instructions contained in the working memory 835 might cause the processor(s) 810 to perform one or more procedures of the methods described herein.

The terms "machine-readable medium," "computer-readable storage medium" and "computer-readable medium," as used herein, refer to any medium that participates in providing data that causes a machine to operate in a specific fashion. These mediums may be non-transitory. In an embodiment implemented using the computer system 800, various computer-readable media might be involved in providing instructions/code to processor(s) 810 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the non-transitory storage device(s) 825. Volatile media include, without limitation, dynamic memory, such as the working memory 835.

Common forms of physical and/or tangible computer-readable media include, for example, a floppy disk, a flexible disk, hard disk, magnetic tape, or any other magnetic medium, a CD-ROM, any other optical medium, any other physical medium with patterns of marks, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 810 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 800.

The communications subsystem 830 (and/or components thereof) generally will receive signals, and the bus 805 then might carry the signals (and/or the data, instructions, etc. carried by the signals) to the working memory 835, from which the processor(s) 810 retrieves and executes the instructions. The instructions received by the working memory 835 may optionally be stored on a non-transitory storage device 825 either before or after execution by the processor(s) 810.

It should further be understood that the components of computer system 800 can be distributed across a network. For example, some processing may be performed in one location using a first processor while other processing may be performed by another processor remote from the first processor. Other components of computer system 800 may be similarly distributed. As such, computer system 800 may be interpreted as a distributed computing system that performs processing in multiple locations. In some instances, computer system 800 may be interpreted as a single computing device, such as a distinct laptop, desktop computer, or the like, depending on the context.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A method for real-time customization of a remote control including a plurality of buttons and one or more sensors, the method comprising:

first determining, at a first time, a first sensor signature that identifies a first user based on analyzing first signals received from the one or more sensors, the first sensor signature associated with first stored configuration data that specifies functionality of a first set of the plurality of buttons of the remote control previously customized for the first user;

first changing functionality, automatically in response to the first determining, of the first set of the plurality of buttons in accordance with the first configuration data;

second determining, at a second time subsequent to the first time, a second sensor signature that identifies a second user based on analyzing second signals received from the one or more sensors, the second sensor signature associated with second stored configuration data that specifies functionality of a second set of the plurality of buttons of the remote control previously customized for the second user;

second changing functionality, automatically in response to the second determining, of the second set of the plurality of buttons in accordance with the second configuration data.

2. The method of claim 1, wherein the first changing functionality comprises:

adjusting respective states of at least some of the first set of the plurality of buttons, such that some of the plurality of buttons are enabled and others of the plurality of buttons are disabled in accordance with the first configuration data; and providing a visual indication on the remote control of which of the plurality of buttons are enabled and/or disabled responsive to the adjusting.

3. The method of claim 2, wherein providing the visual indication comprises illuminating the plurality of buttons in accordance with the respective states.

4. The method of claim 1, wherein:

at least one of the plurality of buttons is both in the first set of the plurality of buttons and in the second set of the plurality of buttons;

the first changing functionality comprises disabling the at least one of the plurality of buttons in accordance with the first configuration data; and the second changing functionality comprises re-enabling the at least one of the plurality of buttons in accordance with the second configuration data.

5. The method of claim 1, wherein:

a particular button of the plurality of buttons is both in the first set of the plurality of buttons and in the second set of the plurality of buttons;

the first changing functionality comprises assigning a first remote command to the particular button in accordance with the first configuration data; and the second changing functionality comprises assigning a second remote command to the particular button in accordance with the second configuration data, the second remote command being different from the first remote command.

6. The method of claim 5, wherein:

pressing the particular button causes a code to be transmitted to a television receiver;

assigning the first remote command to the particular button comprises associating the code with the first remote command at the television receiver, such that pressing the particular button stimulates a first response at the television receiver; and assigning the second remote command to the particular button comprises re-associating the code with the second remote command at the television receiver, such that pressing the particular button stimulates a second response at the television receiver.

7. The method of claim 1, wherein:

the one or more sensors comprises a voice sensor; and the first determining comprises computing a voice signature from the first sensor signature that identifies the first user based on analyzing the first signals received from the voice sensor.

8. The method of claim 1, wherein:

the first determining comprises identifying a first user category based on analyzing the first signals received from the one or more sensors; and the first stored configuration data specifies functionality of the first set of the plurality of buttons corresponding to the first user category.

9. The method of claim 8, wherein:

the first user category is one of a plurality of user categories, wherein one of the plurality of user categories corresponds to an adult user of the remote control, and another of the plurality of user categories corresponds to a child user of the remote control.

10. The method of claim 1, wherein the first set of the plurality of buttons is disjoint from the second set of the plurality of buttons.

11. A remote control comprising:

a plurality of buttons to receive input from a user;

a wireless transmitter to transmit output commands to a receiver in response to button presses;

one or more processors; and a processor-readable memory having stored thereon processor-readable instructions that, when executed by the one or more processors, cause the one or more processors to perform operations including:

first determining, at a first time, a first sensor signature that identifies a first user based on analyzing first signals received from one or more sensors, the first sensor signature associated with first stored configuration data that specifies functionality of a first set of the plurality of buttons of the remote control previously customized for the first user;

first changing functionality, automatically in response to the first determining, of the first set of the plurality of buttons in accordance with the first configuration data;

second determining, at a second time subsequent to the first time, a second sensor signature that identifies a second user based on analyzing second signals received from the one or more sensors, the second sensor signature associated with second stored configuration data that specifies functionality of a second set of the plurality of buttons of the remote control previously customized for the second user;

second changing functionality, automatically in response to the second determining, of the second set of the plurality of buttons in accordance with the second configuration data.

12. The remote control of claim 11, further comprising the one or more sensors.

13. The remote control of claim 11, wherein the processor-readable memory further has stored thereon the first stored configuration data and the second stored configuration data.

14. The remote control of claim 11, wherein the processor-readable instructions, when executed by the one or more processors, cause the one or more processors to perform the first changing functionality by:

adjusting respective states of at least some of the first set of the plurality of buttons, such that some of the plurality of buttons are enabled and others of the plurality of buttons are disabled in accordance with the first configuration data; and providing a visual indication on the remote control of which of the plurality of buttons are enabled and/or disabled responsive to the adjusting.

15. The remote control of claim 11, wherein:

at least one of the plurality of buttons is both in the first set of the plurality of buttons and in the second set of the plurality of buttons;

the processor-readable instructions, when executed by the one or more processors, cause the one or more processors to perform the first changing functionality by disabling the at least one of the plurality of buttons in accordance with the first configuration data; and the processor-readable instructions, when executed by the one or more processors, cause the one or more processors to perform the second changing functionality by re-enabling the at least one of the plurality of buttons in accordance with the second configuration data.

16. The remote control of claim 11, wherein:

a particular button of the plurality of buttons is both in the first set of the plurality of buttons and in the second set of the plurality of buttons;

the processor-readable instructions, when executed by the one or more processors, cause the one or more processors to perform the first changing functionality by assigning a first remote command to the particular button in accordance with the first configuration data; and the processor-readable instructions, when executed by the one or more processors, cause the one or more processors to perform the second changing functionality by assigning a second remote command to the particular button in accordance with the second configuration data, the second remote command being different from the first remote command.

17. The remote control of claim 11, wherein:

the wireless transmitter is to transmit a particular output command to the receiver in response to pressing of the particular button;

assigning the first remote command to the particular button comprises directing the receiver to associate the particular output command with the first remote command, such that pressing the particular button stimulates a first response at the receiver; and assigning the second remote command to the particular button comprises directing the receiver to associate the particular output command with the second remote command, such that pressing the particular button stimulates a second response at the receiver.

18. The remote control of claim 11, wherein:

the one or more sensors comprises a voice sensor; and the processor-readable instructions, when executed by the one or more processors, cause the one or more processors to perform the first determining by computing a voice signature from the first sensor signature that identifies the first user based on analyzing the first signals received from the voice sensor.

19. A television receiver comprising:

a wireless transceiver to communicate with a remote control having a plurality of buttons by which to receive input from a plurality of users;

one or more processors; and a processor-readable memory having stored thereon:

configuration data that specifies functionality of a set of the plurality of buttons of the remote control in association with a first user of the plurality of users;

processor-readable instructions that, when executed by the one or more processors, cause the one or more processors to perform operations including:

determining a sensor signature that identifies the first user based on analyzing signals received from one or more sensors associated with the remote control, the sensor signature associated with the first configuration data;

communicating an instruction to the remote control directing changing functionality of the set of the plurality of buttons in accordance with the first configuration data automatically in response to the determining.

20. The television receiver of claim 19, further comprising the one or more sensors.

* * * * *